US007287935B1

(12) United States Patent
Gehring

(10) Patent No.: US 7,287,935 B1
(45) Date of Patent: Oct. 30, 2007

(54) TENDON ASSEMBLY FOR MOORING OFFSHORE STRUCTURE

(76) Inventor: Donald H. Gehring, 14690 Old Conroe Rd., Conroe, TX (US) 77384

( * ) Notice: Subject to any disclaimer, the term of this patent is extended or adjusted under 35 U.S.C. 154(b) by 715 days.

(21) Appl. No.: 10/621,141

(22) Filed: Jul. 16, 2003

(51) Int. Cl.
*E02B 17/08* (2006.01)

(52) U.S. Cl. ..... 405/223.1; 114/230.27; 114/230.28; 114/214; 405/196; 405/224

(58) Field of Classification Search ..... 405/195.1, 405/205, 223, 224, 224.1, 196, 226; 114/294, 114/295, 311, 296
See application file for complete search history.

(56) References Cited

U.S. PATENT DOCUMENTS

| | | | | |
|---|---|---|---|---|
| 3,330,338 | A * | 7/1967 | Dozier | 166/338 |
| 4,318,641 | A * | 3/1982 | Hogervorst | 405/224 |
| 4,422,806 | A * | 12/1983 | Abbott et al. | 405/227 |
| 4,572,304 | A * | 2/1986 | Mahar et al. | 175/5 |
| 4,615,542 | A * | 10/1986 | Ideno et al. | 285/11 |
| 4,696,603 | A * | 9/1987 | Danaczko et al. | 405/227 |
| 4,721,417 | A * | 1/1988 | Piazza et al. | 405/227 |
| 4,780,026 | A | 10/1988 | Gunderson | 405/224 |
| 4,793,418 | A | 12/1988 | Wheeler et al. | 166/357 |
| 4,797,036 | A * | 1/1989 | Collins et al. | 405/224 |
| 4,854,777 | A * | 8/1989 | Lemoine et al. | 405/202 |
| 4,938,630 | A | 7/1990 | Karsan et al. | 405/224 |
| 5,026,226 | A | 6/1991 | Hollowell et al. | 405/211 |
| 5,522,680 | A | 6/1996 | Hoss et al. | 405/209 |
| 6,488,446 | B1 * | 12/2002 | Riemers | 405/203 |
| 6,752,434 | B2 * | 6/2004 | Cummins | 285/124.1 |
| 2002/0007775 | A1 * | 1/2002 | Woyjeck | 114/294 |
| 2002/0176747 | A1 * | 11/2002 | Hanna et al. | 405/224 |
| 2005/0123358 | A1 * | 6/2005 | Blakseth et al. | 405/224.2 |
| 2006/0127187 | A1 * | 6/2006 | Raines | 405/226 |

* cited by examiner

*Primary Examiner*—Tara L. Mayo
(74) *Attorney, Agent, or Firm*—Bracewell & Giuliani LLP

(57) ABSTRACT

An offshore system for petroleum production has a buoyant platform. A tendon assembly secures to the platform and extends down to a counterweight located near the lower end. A piling is embedded in the sea floor. A socket at the counterweight telescopingly slides over the upper end of the piling to prevent lateral movement of the platform. A dampening chamber is located between the socket and the piling. Ports for the chamber are arranged to allow a faster downward movement of the piling than upward movement.

28 Claims, 8 Drawing Sheets

Fig. 1
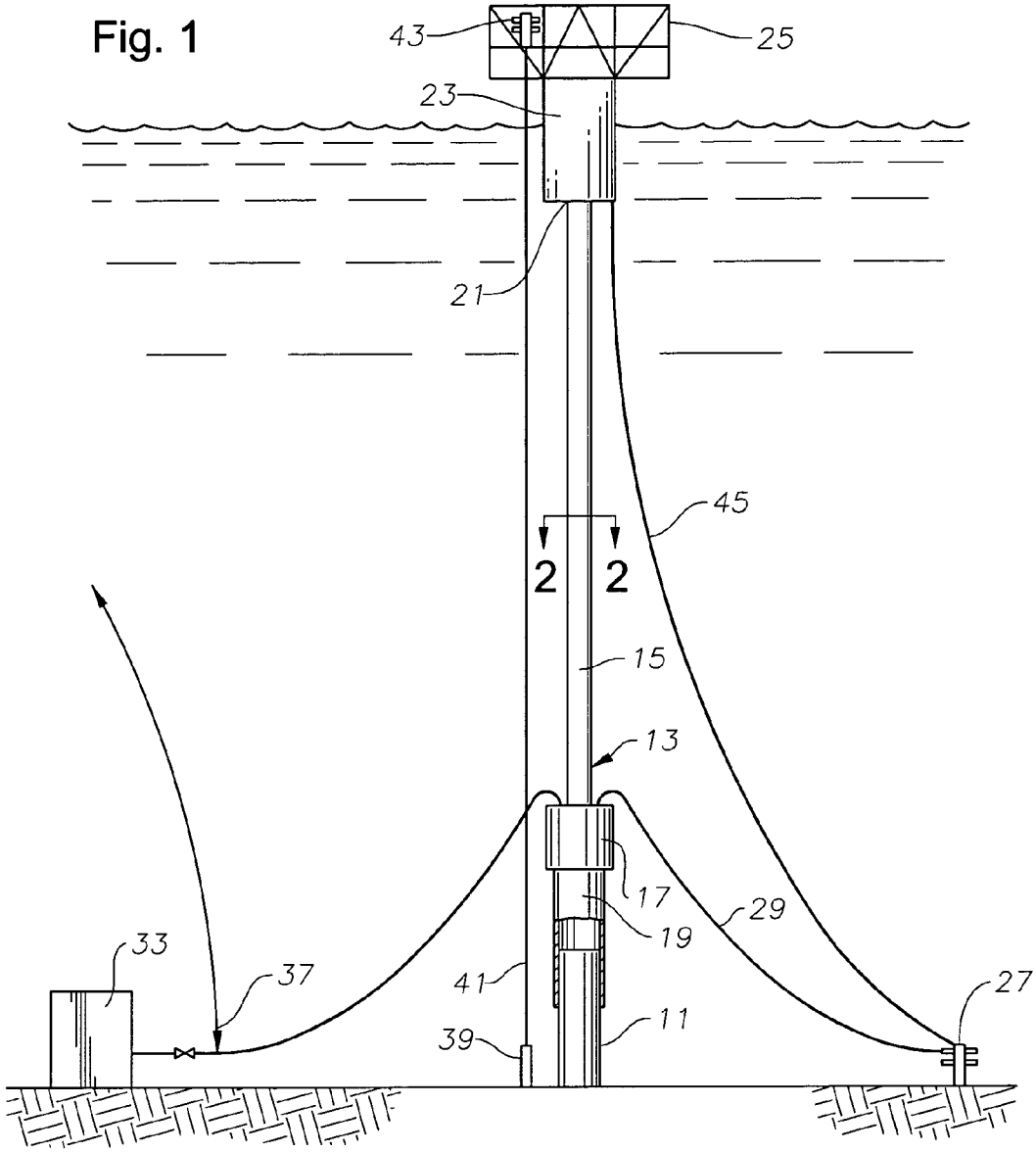
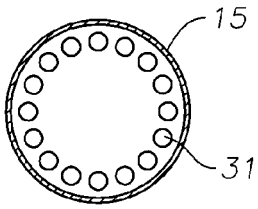
Fig. 2
Fig. 2A
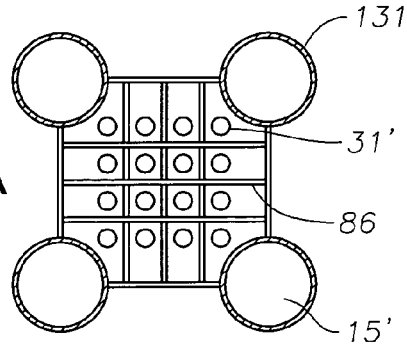

TENDON ASSEMBLY FOR MOORING OFFSHORE STRUCTURE

1. FIELD OF THE INVENTION

This invention relates in general to mooring systems for offshore petroleum production platforms, and in particular to a tendon assembly that utilizes a bottom counterweight to apply tension to the tendon assembly.

2. BACKGROUND OF THE INVENTION

Offshore platforms are used for processing well fluid from subsea wells. Early offshore structures were supported from the bottom or sea floor. Sea floor supported platforms are still often used in shallow water. When the wells are depleted, most governments require that the structure be removed. These bottom supported platforms, being embedded in the sea floor, are not reused, rather are scrapped at considerable expense after one use. The removal costs are particularly high because these platforms are normally too large to be lifted out of the water, therefore must be cut up and dumped in approved offshore deep water dumping sites.

Floating offshore platforms are utilized in deeper water. These floating structures include tension leg platforms and spars, both of which are moored to the sea floor by tension legs or catenary lines. Because deep water floating platforms are very costly, their use has been restricted to only large field developments.

3. SUMMARY OF THE INVENTION

The offshore system of this invention utilizes a buoyant hull or platform. A tendon assembly engages the platform and extends downward to near the sea floor. A counterweight is located at the lower end of the assembly to provide tension to the tendon assembly.

An anchor member, such as a piling or a caisson, is embedded in the sea floor and has an upper end protruding above the sea floor. The tendon assembly has an engaging member at the lower end that telescopingly engages the upper end of the anchor member. This engagement allows upward and downward movement of the tendon assembly relative to the anchor member, however it prevents lateral movement of the platform.

Preferably, the engaging member and the anchor member define a chamber that varies in volume as the tendon assembly moves up and down due to heave of the platform. The chamber has a port to draw in and expel sea water. The inward and outward movement of sea water from the chamber dampens the upward and downward motion of the tendon assembly.

In one embodiment, a valve is mounted over the port for varying the cross-sectional flow area and thus the dampening. Also, preferably the port or ports are arranged such that there is a larger cross sectional flow area for expelling water from the chamber than the flow area for drawing sea water into the chamber. This allows faster downward movement of the tendon assembly than upward movement.

Risers for transporting petroleum products between the platform and sea floor may be either internal to the tendon assembly, external or a combination of both. An anti-rotation device between the engaging member and the upper end of the anchor member prevents rotation of the engaging member. One or more external risers can extend from a subsea well through part of the counterweight to prevent rotation of the counterweight.

In some of the embodiments, the tendon assembly comprises one or more tendons of substantially of constant diameter that extend from the counterweight to the floating platform. In another embodiment, the tendon assembly is made up of a lower tendon section that extends upward to an upper riser section. The upper riser section is larger in diameter than the lower tendon section but shorter in length. An upper weight may be secured to the lower end of the upper riser section for applying tension to the upper riser section. The upper riser section and lower tendon section may be secured rigidly together or may have a flex joint between them. Furthermore, in one embodiment, the lower tendon section is lowered through the upper riser section and lands on a hanger in the upper riser section.

In one method of installation, the tendon assembly is assembled and positioned in engagement with the upper end of the anchor member. The tendon assembly is preferably sealed from sea water throughout much of its length to provide buoyancy and maintain it vertically. A vessel tows the platform hull over the tendon assembly, then ballasts the hull until it moves downward into engagement with the upper end of the tendon assembly. The upper end of the tendon assembly is then connected to the platform. One method of connecting is by rotating the platform to position lugs in engagement with each other. After connection, the ballast in the hull is reduced to apply tension to the tendon assembly.

4. BRIEF DESCRIPTION OF THE DRAWINGS

FIG. 1 is a schematic view illustrating a platform moored by a tendon assembly constructed in accordance with this invention.

FIG. 2 is a sectional view of the tendon assembly of FIG. 1, taken along the line of 2-2 of FIG. 1.

FIG. 2*a* is a sectional view of an alternate embodiment of the tendon assembly of FIG. 1, showing a plurality of tendons.

Figure 3:
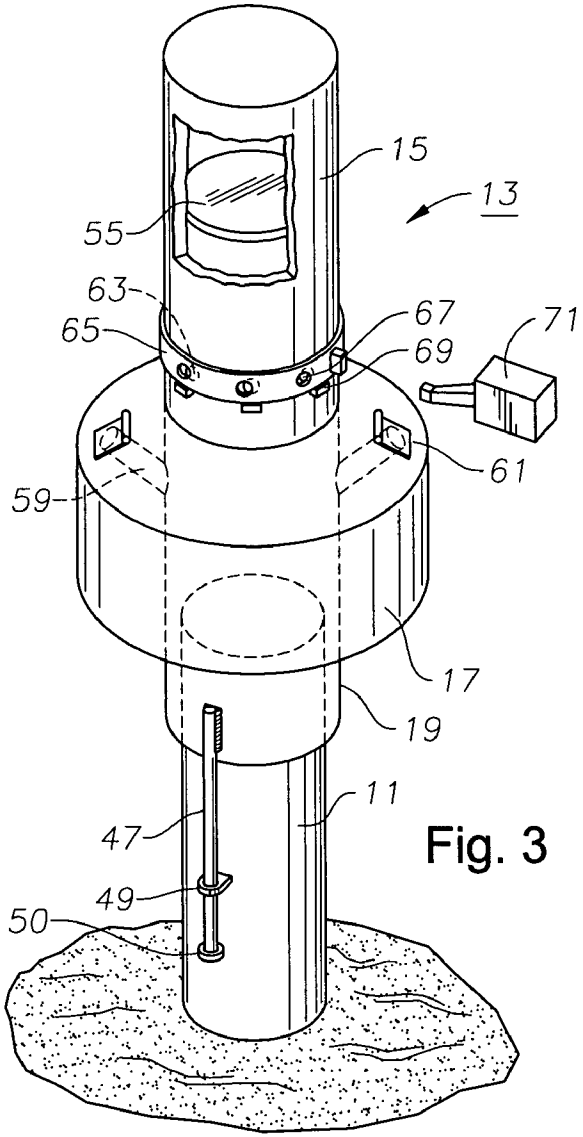

FIG. 3 is an enlarged isometric view of the counterweight and socket of the tendon assembly of FIG. 1, with flowline attachments being removed for clarity.

Figure 4:
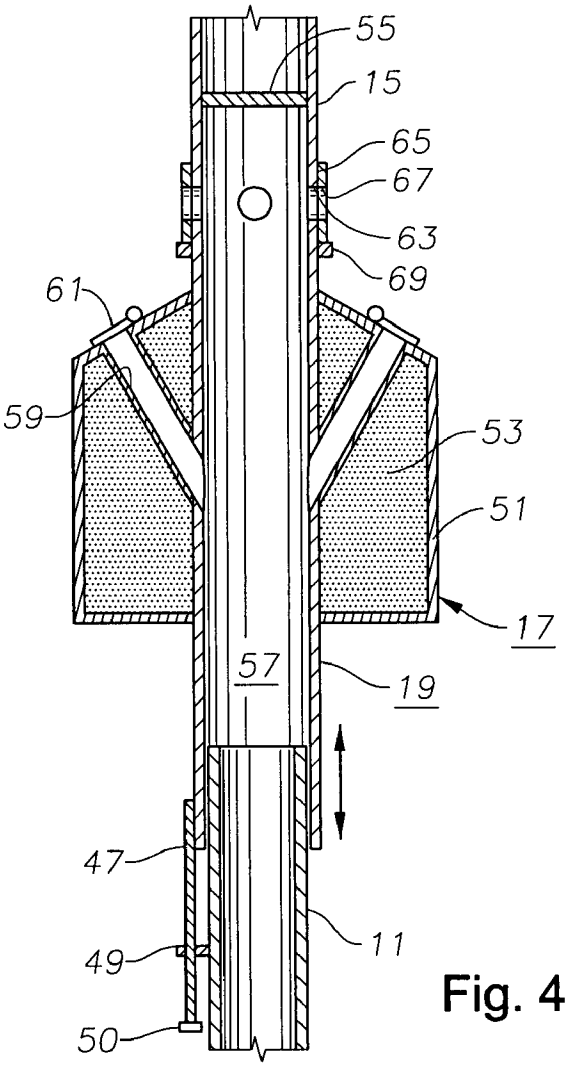

FIG. 4 is a vertical sectional view of the counterweight and socket shown in FIG. 3.

Figure 5:
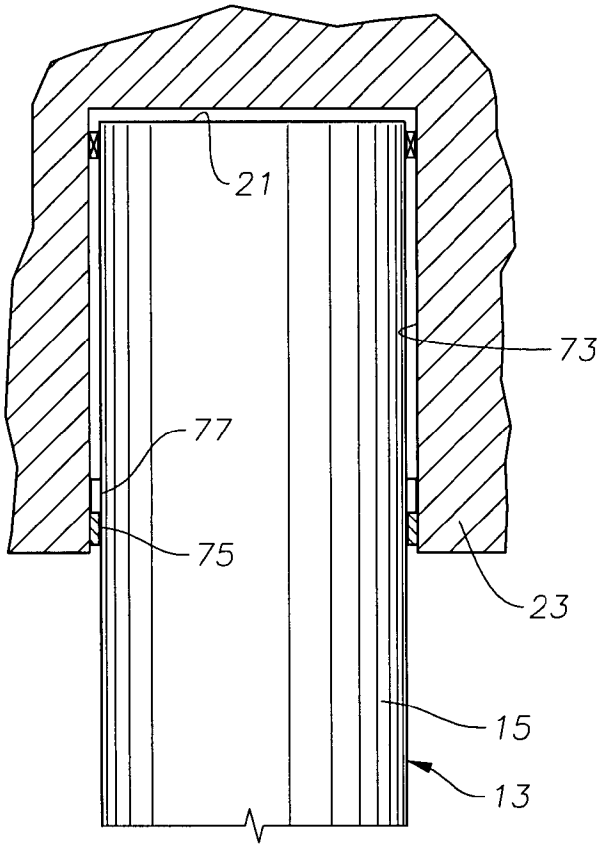

FIG. 5 is a sectional view of the upper end of the tendon assembly of FIG. 1, shown received within a receptacle of the floating platform.

Figure 6:
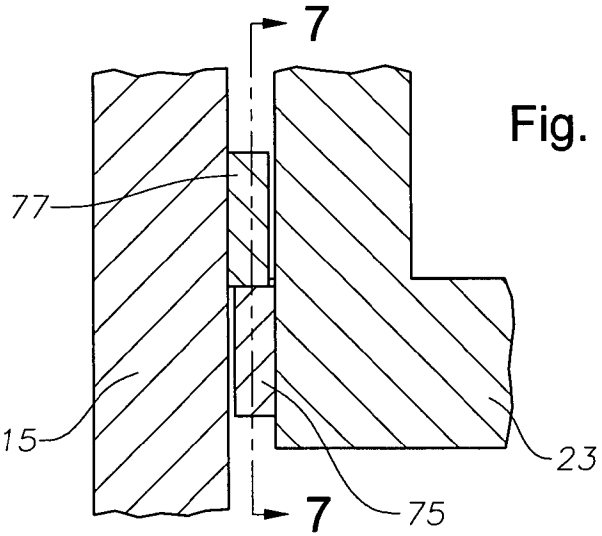

FIG. 6 is an enlarged sectional view of the connection between a portion of the upper end of the tendon assembly and a portion of the floating platform.

Figure 7:
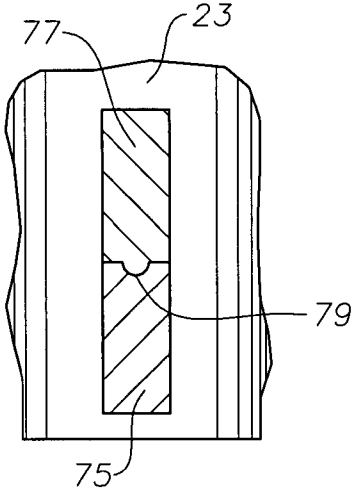

FIG. 7 is a sectional view of the connection of FIG. 6, taken along the line 7-7 of FIG. 6.

Figure 8:
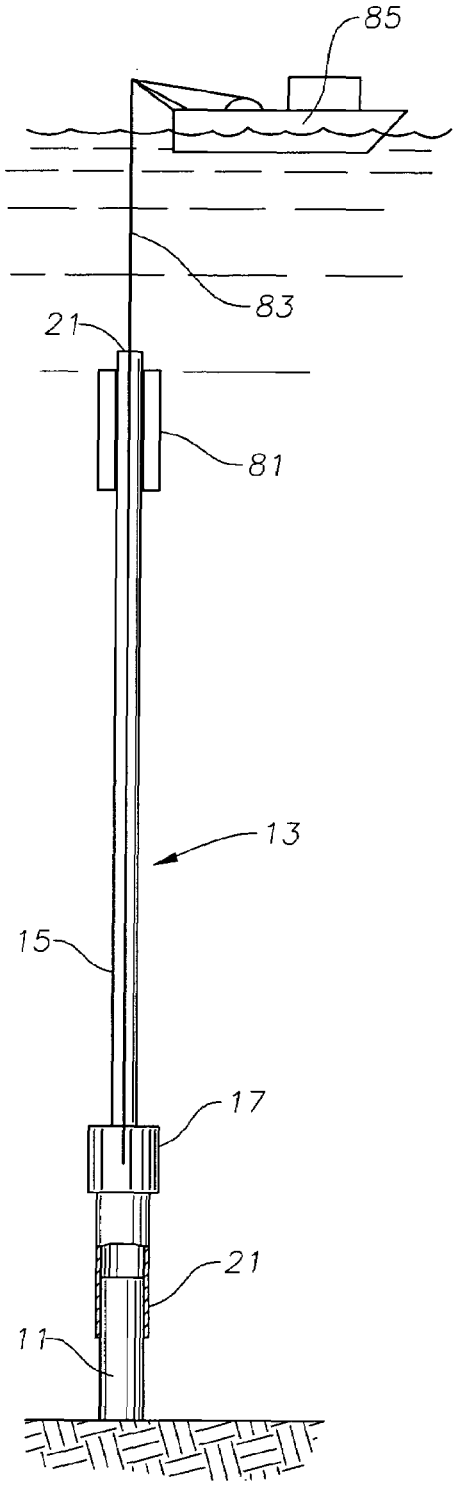

FIG. 8 is a schematic view illustrating the tendon assembly of FIG. 1 being installed and counterweight material being filled in the counterweight.

Figure 9:
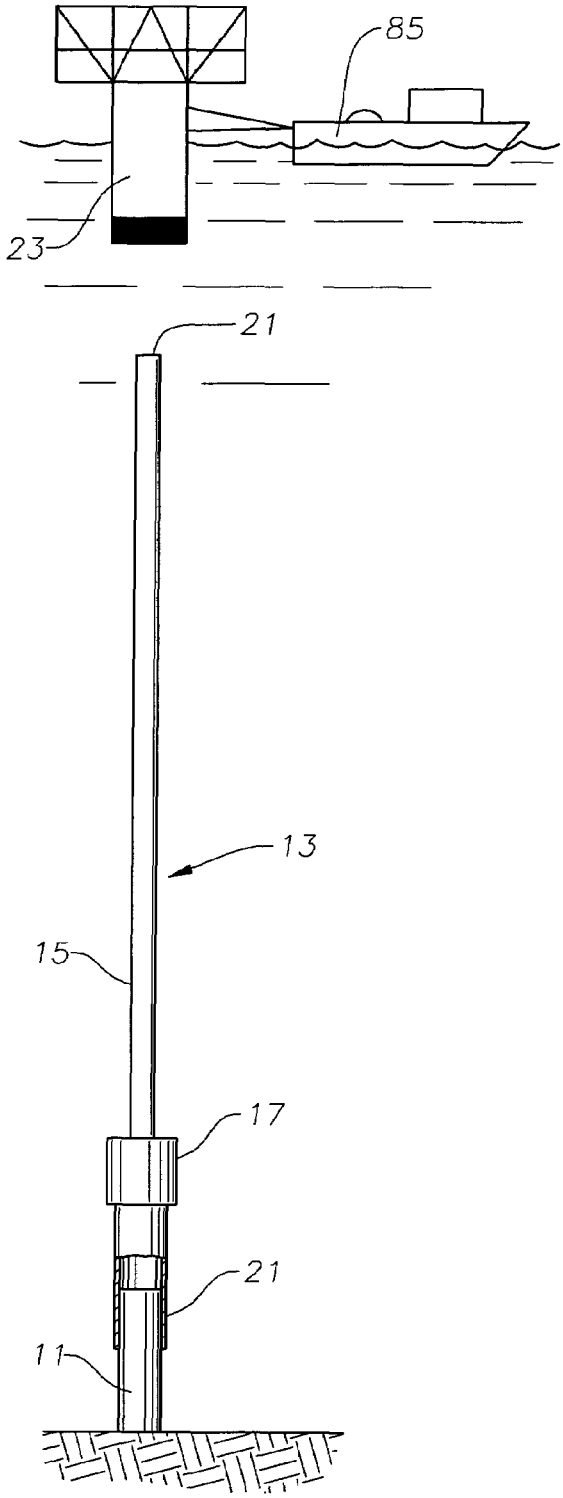

FIG. 9 is a schematic view of the tendon assembly of FIG. 1, with the hull positioned over the tendon assembly for connection to the tendon assembly.

Figure 10:
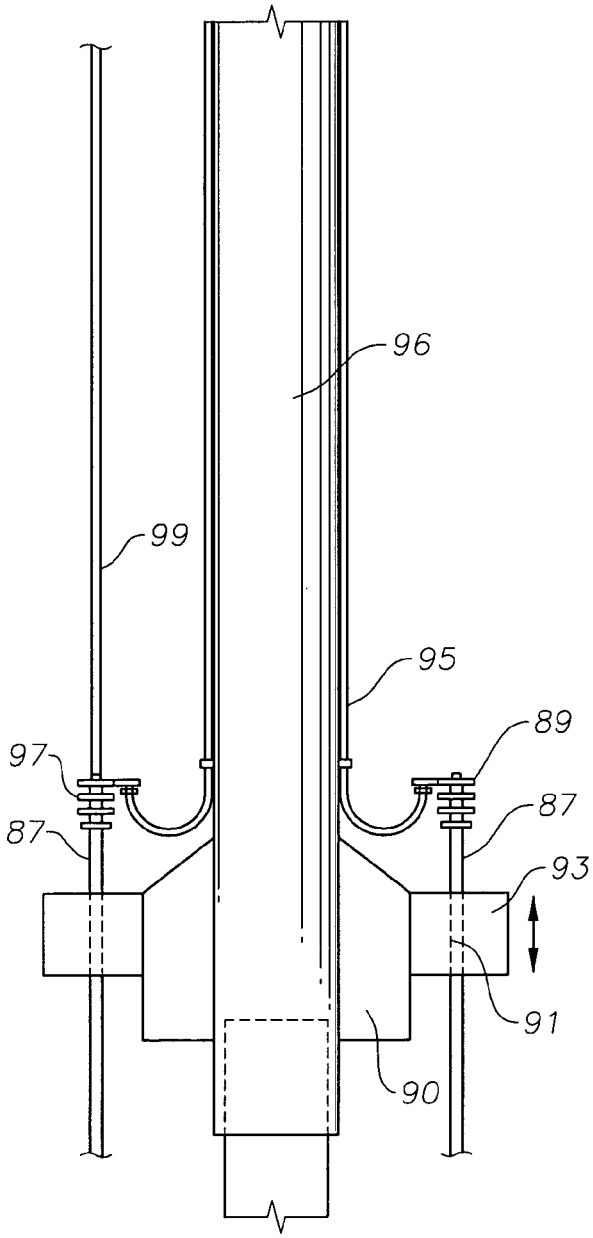

FIG. 10 is a schematic view of a lower portion of an alternate embodiment of a tendon assembly.

Figure 11:
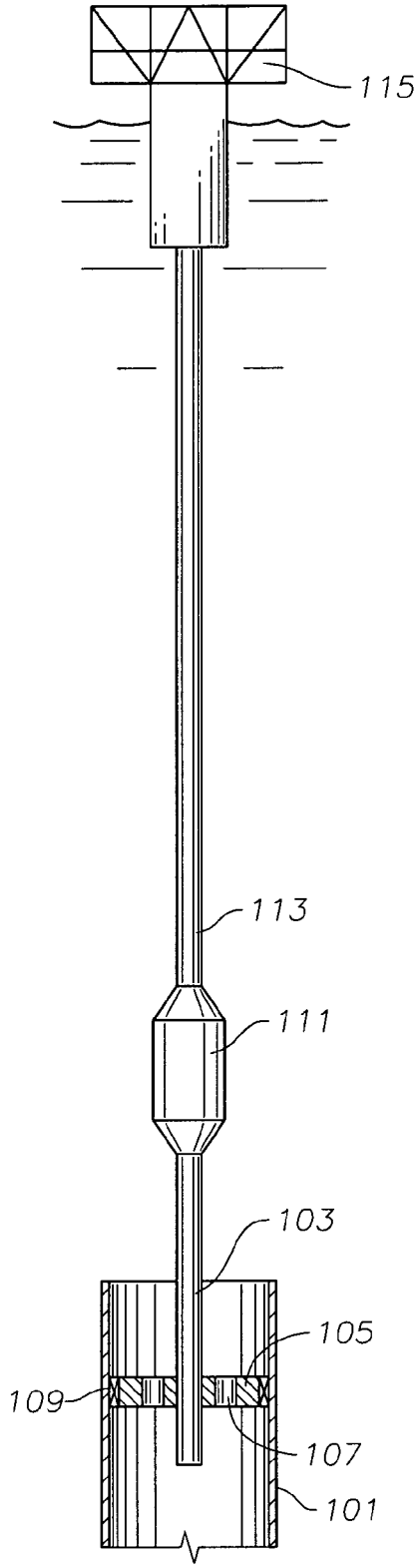

FIG. 11 is an isometric view of another alternate embodiment of a tendon assembly.

Figure 12:
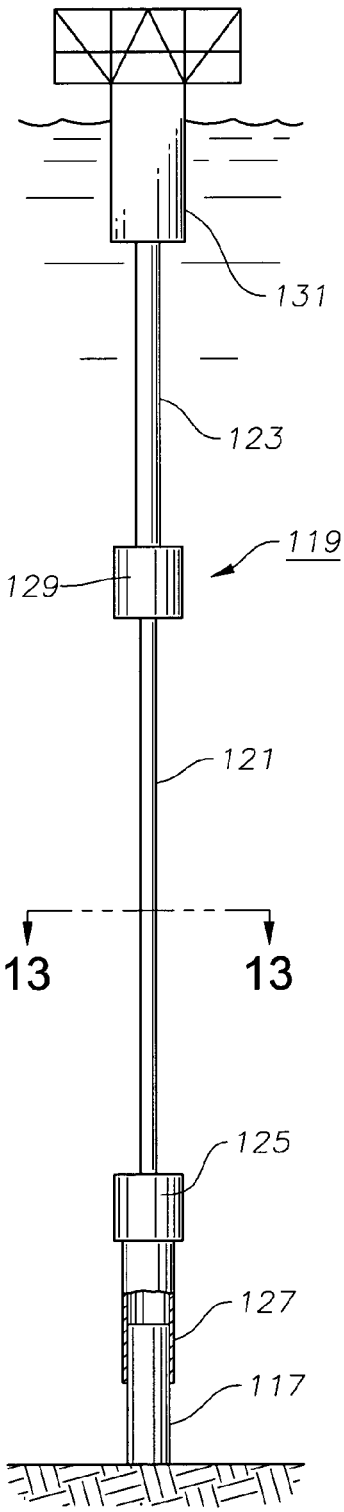

FIG. 12 is a schematic view of another embodiment of a tendon assembly.

Figure 13:
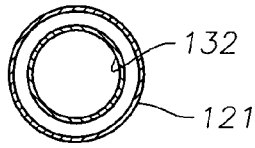

FIG. 13 is a sectional view of the tendon assembly of FIG. 12, taken along the line 13-13 of FIG. 12.

Figure 14:
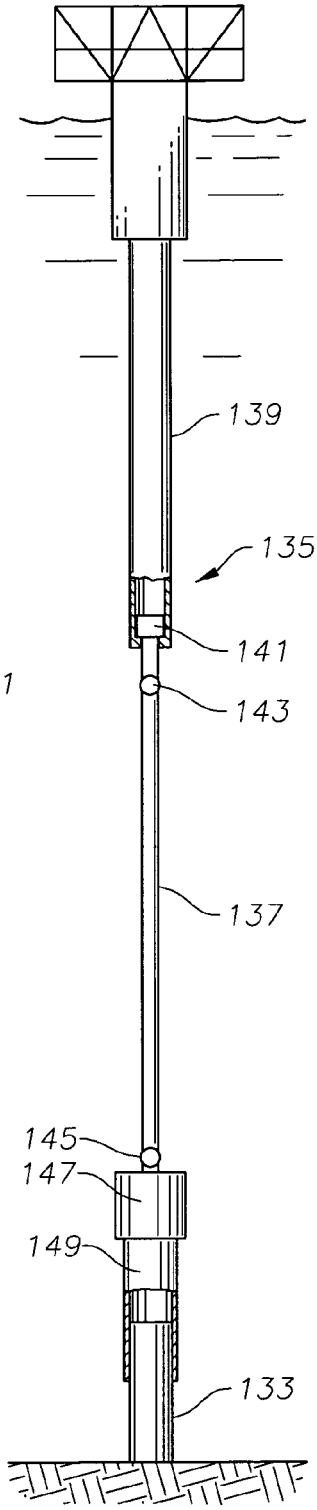

FIG. 14 is an isometric view of another embodiment of a tendon assembly.

Figure 15:
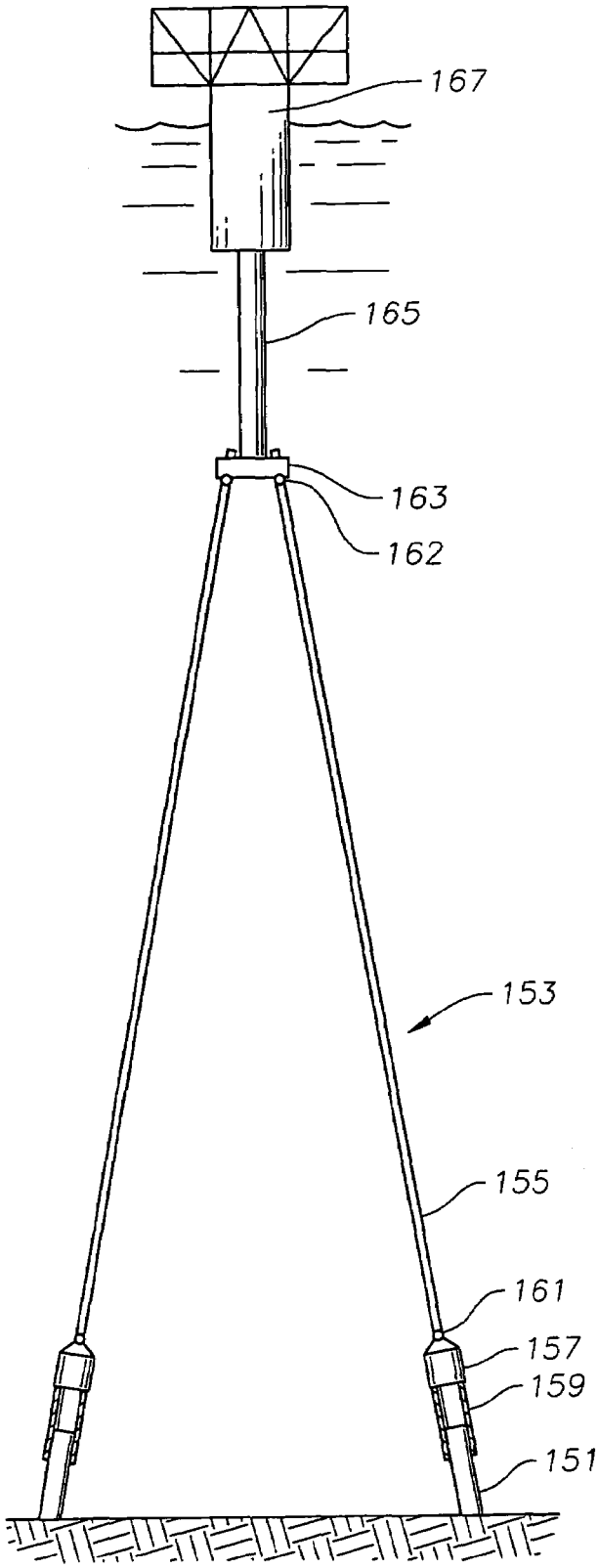

FIG. 15 is a schematic view of another embodiment of a tendon assembly.

Figure 16:
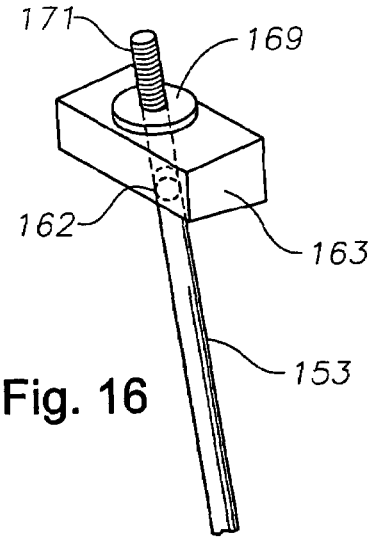

FIG. 16 is an enlarged view of an upper weight of the tendon assembly of FIG. 15.

Figure 17:
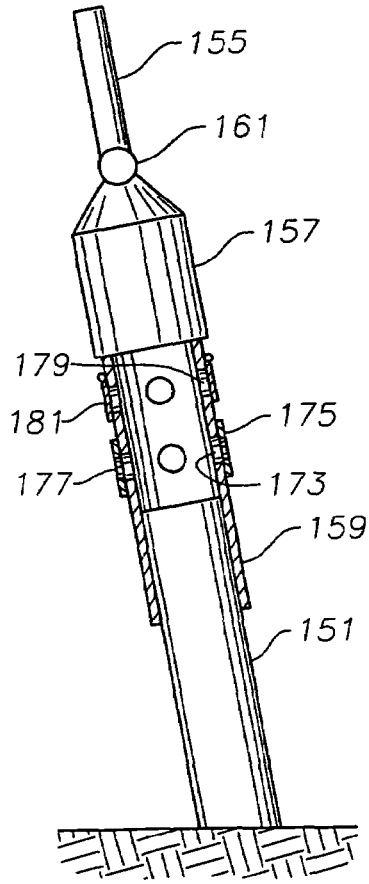

FIG. 17 is a sectional view of the lower counterweight and socket of the tendon assembly of FIG. 16.

Figure 18:
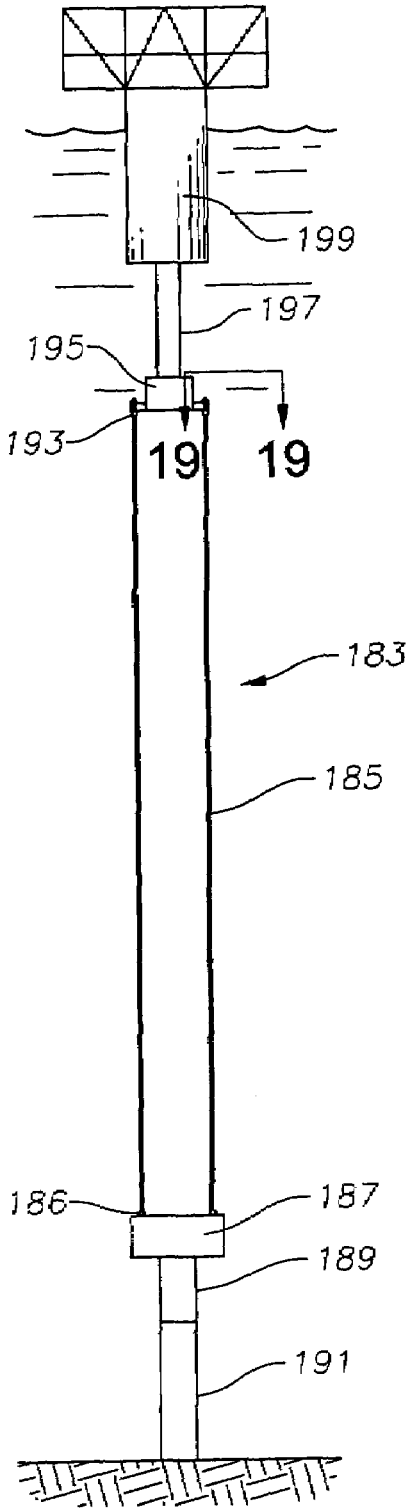

FIG. 18 is a schematic view of another embodiment of a tendon assembly.

Figure 19:
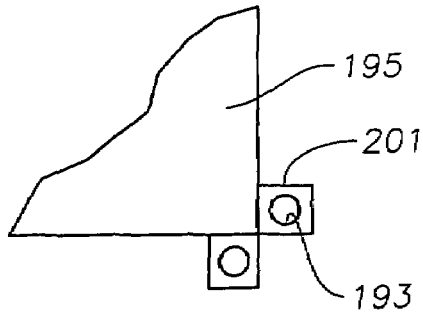

FIG. 19 is a sectional view of the tendon assembly of FIG. 18, taken along the line 19-19 of FIG. 18.

Figure 20:
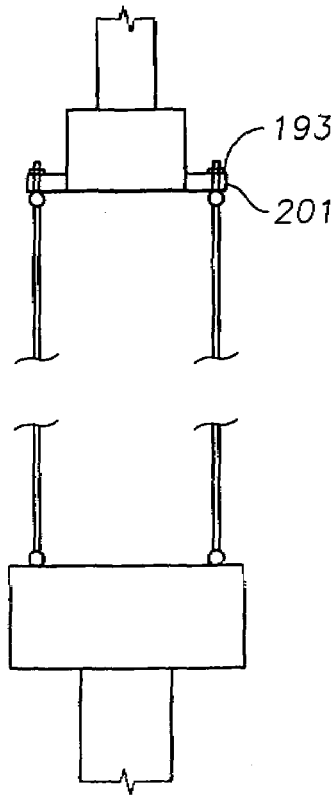

FIG. 20 is an enlarged schematic view of a portion of the tendon assembly of FIG. 18.

5. DETAILED DESCRIPTION OF THE INVENTION

Referring to FIG. 1, an anchor member or piling 11 is embedded in the sea floor and protrudes upward for a selected distance. Piling 11 is preferably a steel tubular member that is embedded into the sea floor either by conventional driving or by a suction technique. Piling 11 will extend to a depth that is necessary for its purpose, however piling 11 is not a well and is not open to any communication with earth formations.

A tendon assembly 13 extends upward from piling 11 and is stabilized against lateral movement by piling 11. Tendon assembly 13 includes a tendon section 15 that is comprised of one or more tubular members. Tendon assembly 13 also includes a counterweight 17 located adjacent to its lower end. Counterweight 17 is a large structure that has sufficient weight to apply tension throughout the length of tendon section 15.

Tendon assembly 13 also has a socket 19 on its lower end that slides over piling 11 in telescoping engagement. Socket 19 is able to move upward and downward relative to piling 11. Socket 19 may comprise a tubular member secured to and extending downward from counterweight 17. Alternately, tendon section 15 may extend through counterweight 17, with socket 19 comprising the lower end of tendon section 15. Also, socket 19 could be formed within and surrounded by counterweight 17 in a manner such that it does not extend below counterweight 17.

The upper end 21 of tendon assembly 13 is secured to a floating platform or hull 23. Hull 23 may take a variety of shapes, and in the position shown, has the configuration of a cylinder with an axis that is perpendicular to seal level. Hull 23 is buoyant and has a deck 25 located on its upper end above the sea level. The engagement of tendon assembly 13 with piling 11 provides the entire mooring system for hull 23 in this embodiment. No additional mooring is necessary. Upward and downward movement of tendon assembly 13 is allowed as hull 23 moves up and down due to wave motion. The engagement of socket 19 with piling 11, however, prevents lateral movement of hull 23.

Tendon assembly 13 not only provides mooring for hull 23, but can also assist in transporting petroleum products to and from hull 23. Deck 25 will normally have processing equipment for processing oil and gas, particularly separating oil, water and gas and injecting sea water.

The subsea equipment in deep water would typically include a plurality of subsea trees 27 (only one shown). Each tree 27 has a flowline jumper 29 that leads to hull 23 or tendon assembly 13. In this embodiment, flowline jumper 29 leads to the upper end of counterweight 17. Flowline jumper 29 connects to a riser, such as an internal riser 31 (FIG. 2) that leads to deck 25. Internal risers 31 transport petroleum products to and from the sea floor and deck 25. Each riser 31 has an axis that is separate from the axes of the other risers 31 and from the axis of tendon 15. Risers 31 are shown spaced in a circular array around the axis of and within tendon section 15.

Additional equipment on the sea floor may include a storage tank 33 for storing oil and exporting oil through pipeline 37. Pipeline 37 could also be used to import oil for storage in tank 33. Pipeline 37 could also be used to export petroleum products directly. Furthermore, subsea wellheads 39 (only one shown) that do not have subsea trees on them may be located close to piling 11. In this example, subsea wellhead 39 is connected to an external riser 41 that extends vertically from wellhead 39 to platform 25. A surface tree 43 is located at the upper end of riser 41 on platform deck 25 rather than on the sea floor like subsea tree 27. Vertical external riser 41 extends alongside tendon assembly 13 and provides direct access at all times to the subsea wellhead 39.

FIG. 1 also shows a catenary import/export riser 45 that extends from hull 23 to the sea floor for transporting petroleum products to hull 23 for processing and for reconveying the products back to the sea floor for shipment along a pipeline such as pipeline 37. Subsea tree 27, subsea wellhead 39, tank 33 and catenary riser 45 are merely exemplary and may not all be present in the same installation.

Referring to FIGS. 3 and 4, an anti-rotation rod 47 is shown extending from socket 19 downward through a bracket 49 secured to the exterior of piling 11. Typically there will be a plurality of anti-rotation rods 47, although only one is shown. Rods 47 prevent socket 19 from rotation relative to piling. Other types of anti-rotation devices are feasible as well. A stopper 50 is shown in this embodiment at the bottom of the anti-rotation device 47 to prevent accidental disconnection in a major storm.

As illustrated in FIG. 4, counterweight 17 preferably includes a container 51 that holds a slurry 53 of very heavy material, typically metallic. Although not shown, an inlet port to the interior of container 51 allows the heavy slurry to be pumped into a container 51 after it has been lowered to a subsea position over piling 11.

A closure plate 55 is shown blocking the interior of tendon 15 near its lower end. Since piling 11 is closed at its lower end, piling 11 and tendon 15 define a chamber 57 with plate 55 being the upper end. Chamber 57 varies in volume as tendon 15 moves upward and downward relative to piling 11. Chamber 57 is open to sea water through one or more ports 59. Ports 59 are shown extending through counterweight 17, but could also be located above or below counterweight 17.

Preferably check valves 61 are located in ports 59 to allow sea water in chamber 57 to be expelled from chamber 57 but not flow back inward. Inlet ports 63 in tendon section 15 above counterweight 17 are provided for the intake of sea water during the upward stroke of tendon 15. Inlet ports 63 are spaced circumferentially around tendon 15 and have an adjustable valve ring 65 mounted around them. Valve ring 65 has apertures 67 that will register with inlet ports 63. Valve ring 65 is rotatable on tendon 15 to align and misalign ports 63 with apertures 67. Lugs 69 located below valve ring 65 provide support to valve ring 65. An ROV (remote operated vehicle) 71 is remotely controlled from the surface for rotating valve ring 65 to adjust the alignment of apertures 67 with ports 63.

On the upstroke, all fluid must enter through ports 63 and apertures 67. Reducing the effective flow area by rotating ring 65 to a position of further misalignment will reduce the flow area. This reduction of flow area reduces the speed at which tendon 15 moves upward, thus increasing the dampening. On the other hand, during the down stroke, check valves 61 are open to allow tendon 15 to move downward more quickly than it moves upward. On the down stroke, some flow will also be expelled through ports 63 and apertures 67. The effective flow area for the down stroke is preferably greater than the effective flow area for the upstroke to allow this quicker downward movement than the upward movement. Additionally, both during the down stroke and the upstroke, some flow will occur in the clearances between piling 11 and the inner diameter of socket 19.

Other port and valve arrangements are feasible that would allow a faster down stroke than upstroke. Also, port 63 and valve ring 65 could be located below counterweight 17 rather than above. Closure plate 55 could also be located at a lower position than shown as long as it is located above ports 63. If adjustability is not required, valve ring 65 could be eliminated.

FIG. 5 illustrates one manner to attach the upper end 21 of tendon assembly 13 to hull 23. This attachment is rigid so that upward and downward movement of hull 23 will cause upward and downward movement in unison of tendon assembly 13. In the example shown, tendon upper end 21 locates within a cylindrical receptacle 73 in hull 23. Receptacle 73 optionally may have a closed upper end to limit downward movement of hull 23 relative to tendon assembly 13 while the connection of upper end 21 to hull 23 is being made. A plurality of hull lugs 75 are spaced around the circumference of receptacle 73 both near the lower end and near the upper end of receptacle 73. A plurality of tendon lugs 77 are secured to the exterior of tendon upper end 21 for engaging hull lugs 75. Tendon lugs 77 are spaced the same circumferential distances apart from each other as hull lugs 75.

Tendon lugs 77 will pass through the spaces between hull lugs 75 as hull 23 is ballasted down over tendon upper end 21. Then, rotating hull 23 an increment relative to tendon upper end 21 will place tendon lugs 77 directly above hull lugs 75. A detent 79 is formed between the mating upper and lower edges of each hull lug 75 and tendon lug 77, as shown in FIG. 7. Detent 79 resists any further rotation of hull 23 relative to tendon upper end 21 after lugs 75 and 77 are in engagement.

FIG. 8 illustrates tendon assembly 13 during an installation process. Initially, piling 11 is driven or embedded in the sea floor by suction techniques. In one method, tendon 15 is assembled at the shore, sealed from the entry of sea water and towed to the site in a horizontal orientation by a vessel 85 along with empty counterweight 17 at its end. Alternately, tendon 15 could be made up in sections that are assembled at the site. In the embodiment of FIG. 8, tendon 15 is pre-assembled into the desired length and towed to the site. Then, selected ballast is applied to cause tendon 15 to rotate from a horizontal towing position to a vertical position. Buoyancy cans 81 may optionally be provided to assist in this upending operation. Socket 19 is positioned over and above piling 11 and the buoyancy of can 81 is reduced until socket 19 fits over piling 11. Then, slurry 53 (FIG. 4) is pumped from the surface into container 51 of counterweight 17. This is done preferably by the use of a fill line 83 extending from vessel 85.

Once that procedure is complete, tendon assembly 13 will extend vertically upward in the position of FIG. 9 due to its buoyancy. Preferably, the interior of tendon 15 remains sealed to sea water, thus providing the buoyancy in the upper portion of tendon 15 to enable it to remain in the vertical position of FIG. 9 without any tensioning lines. Either closure plate 55 (FIG. 3) or an internal shoulder in socket 19 will rest on piling 11, which supports the weight of tendon assembly 13.

Then, vessel 85, or another vessel, tows hull 23 over upper end 21 of tendon assembly 13. Upper end 21 will be located below sea level a sufficient distance so that hull 23 will pass above it. Then, additional ballast is applied to hull 23 to cause it to lower into receptive engagement with upper end 21 of tendon assembly 13. Then, the operator connects upper end 21 to hull 23, such as by rotation of hull 23 as previously described. Once lugs 75, 77 (FIG. 5) engage each other, the ballast in hull 23 is reduced to pull upward on tendons assembly 13, thus increasing tension in tendon section 15. This will cause counterweight 17 to lift from its resting position wherein its weight is supported by piling 11. The ballast in hull 23 is reduced until counterweight 17 reaches a desired median position between its uppermost and lowermost stroke positions.

In the operation of the embodiments of FIGS. 1-9, lateral stability of hull 23 is provided by the engagement of socket 19 with piling 11. Counterweight 17 provides sufficient weight to apply tension to tendon assembly 13. Counterweight 17 also dampens upward and downward movement of hull 23. The dampening is provided by sea water moving into and outward from chamber 57 (FIG. 4). During the down stroke, sea water flows outward through ports 59 and 63 as chamber 57 becomes smaller in volume. During the upstroke, with chamber 57 increasing in volume, sea water flows in through ports 63. This inward flow of sea water occurs at a lesser rate than the expelling of sea water because of the lesser flow area, thus dampening the upward or heaving movement of hull 23.

FIG. 2A illustrates an alternate embodiment for tendon section 15. In FIG. 1, a single tendon 15 extends from counterweight 17 to hull 23. In FIG. 2A, a plurality of tendons 15' extend over the same distance. Tendons 15' are parallel to each other and spaced in an array about an axis. Risers 31' may be located within the array and supported by guides 86 that extend between tendons 15'.

In the alternate embodiment of FIG. 10, rather than utilize anti-rotation rods 47 (FIG. 3), short well risers 87 provide the anti-rotation resistance. Well risers 87 extend upward from wells to a short distance above counterweight 90 and have subsea trees 89 mounted to their upper ends. Counterweight 90 has holes 91 in lateral brackets 93 that extend laterally outward from counterweight 90. Each well riser 87 extends through one of the holes 91. Holes 91 allow upward and downward movement of counterweight 90 relative to riser 87. The engagement of risers 87 with holes 91, however, prevents any rotational movement. Alternately, holes 91 could extend directly through counterweight 90 rather than through brackets 93.

Tree 89 is connected via a jumper to an external riser 95 that extends alongside tendon 96 to the surface. FIG. 10 also shows a subsea tree 97 configured the same as tree 89 and also located on a riser 87. A vertical access riser 99 is shown extending from subsea tree 97 to the hull (not shown) at the surface. Vertical access riser 99 allows vertical access for performing operations on the well of subsea tree 97. Vertical access riser 99 could be permanent or it could be removable and installable on other subsea trees, such as subsea tree 89.

Another embodiment is shown in FIG. 11. Rather than piling 11, a caisson 101 is employed. Caisson 101 is larger in diameter than piling 11 (FIG. 1) and not embedded in the sea floor to as great an extent. Caisson 101 is particularly applicable for areas of the sea floor that are not susceptible to driving pilings.

The engaging member in this embodiment is not a socket, rather it comprises a shaft 103 and a piston 105. Piston 105 locates within caisson 101 for telescoping movement relative to caisson 101. A plurality of holes 107 may be provided in piston 105 for allowing flow from below piston 105 to above piston 105. A valve arrangement could be utilized so that a larger flow area is provided for downward movement of piston 105 than for upward movement. Wear plates 109 are schematically illustrated around the outer diameter of piston 105 for engaging the interior sidewall of caisson 101.

Counterweight 111 may be the same as previously described and is shown located at the upper end of engaging member 103. Counterweight 111 is located adjacent the lower end of tendon 113, which extends to hull 115. The system of FIG. 11 will operate in the same manner as the other embodiments. Caisson 101 could be utilized with all of the embodiments of this application rather than a piling, if desired.

FIG. 12 shows another embodiment. A piling 117 that is of the same type as piling 11 (FIG. 1) is embedded in the earth. A tendon assembly 119 includes a lower tendon section 121 and an upper riser section 123. Lower tendon section 121 is much smaller in diameter than upper riser section 123. Upper riser section 123 typically extends only a few hundred feet, however, while lower tendon section 121 may extend thousands of feet.

A lower counterweight 125 of the same type as previously described is located adjacent the lower end of lower tendon section 121. Lower counterweight 125 provides tension to lower tendon section 121 as well as to upper riser section 123. A socket or sleeve 127 extends downward from lower counterweight 125 at the lower end of tendon assembly 119. Socket 127 extends over piling 117 and operates in the same manner as previously described.

In this embodiment, an upper counterweight 129 is located at the lower end of upper riser section 123. Upper counterweight 129 may be approximately the same weight as lower counter weight 125. The upper end of upper riser section 123 rigidly attaches to hull 131.

In this embodiment, the connection between lower counterweight 125 and tendon 121 and the connection between tendon 121 and upper counterweight 129 are rigid. This system is utilized in deep water, and some lateral flexibility is provided through the flexibility of tendon 121 due to its long length. Riser section 123, however, being shorter and larger in diameter, is rigid and is rigidly attached both to hull 131 and to upper weight 129. Upper weight 129 provides further stability to hull 131.

Lower tendon section 121 may be smaller in diameter than tendon 15 of FIG. 1. Rather than a plurality of separate internal risers, a single riser 132 may extend through tendon 121. Riser 132 enables to two flow streams to pass through tendon 121. The flow streams could be separate components, such as oil in riser 132 and gas in the annular space surrounding riser 132, or vice versa. Also, the two passages provided by riser 132 could be utilized for upward flow of one fluid and downward flow of another fluid. This internal riser 132 could also provide redundancy in the event of failure of lower tendon section 121. The multiple flow streams through tendon 121 also allow thermal benefits.

The embodiment of FIG. 14 employs a piling 133 that may be the same as piling 117 or piling 11 (FIG. 1). Tendon assembly 135 has a lower tendon section 137 and an upper riser section 139. Upper riser section 139 may have an upper counterweight 129 as shown in the embodiment of FIG. 12. A hanger 141 is located at the upper end of lower tendon section 137. Hanger 141 supports the upper end of lower tendon section 137 on a shoulder within the lower end of upper riser section 139. The engagement of hanger 141 on the shoulder is a rigid connection, preventing any upward or downward movement of upper riser section 139 relative to lower riser section 137.

A ball joint 143, schematically illustrated, preferably is located at the connection of hanger 141 and upper riser section 139. Also, a ball joint 145 is preferably located at the upper end of a counterweight 147. Ball joints 143, 145 allow some flexing movement of lower tendon section 137 in cases of shallow water where lower tendon 137 would be fairly stiff due to a short length. As in the other embodiments, a socket 149 extends downward from counterweight 147 and over piling 133.

If desired, upper riser section 139 may be made sufficiently large so that lower tendon section 137 can be lowered through upper riser section 139 while upper riser section 139 is suspended vertically from a vessel. In such case, the vessel would have a derrick and the capability of securing sections of lower riser 137 together while lowering them through upper riser section 139. In the event that counterweight 147 is too large to pass through upper riser 139, it could be installed separately and lower tendon section 137 stabbed into engagement with counterweight 147.

The embodiment of FIG. 15 differs in that more than a single tendon assembly is employed. A plurality of pilings 151 are driven or otherwise installed in the sea floor. In this embodiment, pilings 151 are shown inclined to vertical rather than vertical as in the other embodiments. However, they could be vertical, if desired. Also, although only two pilings 151 are shown, more than two could be utilized.

A tendon assembly 153 extends to each piling 151. Each tendon assembly 153 has a lower tendon section 155 with a counterweight 157 and a socket 159, as in the other embodiments. A flexible joint 161 is preferably located at the upper end of each counterweight 157. Sockets 159 engage pilings 151 in the same manner as previously described. Lower tendon sections 155 extend to an upper counterweight 163, which in turn is secured rigidly to the lower end of an upper riser section 165. A flexible joint 162 is located at the upper end of each tendon section 155. Upper riser section 165 is joined to the lower end of hull 167.

In this embodiment, a top connector 169 for each tendon assembly 153 is located on upper weight 163. Each top connector 169 engages a plurality of grooves 171 formed on the upper end of each of the tendons 155. Top connector 169 may be of a conventional type used for securing tendons of a conventional tension leg platform.

As illustrated in FIG. 17, valve ports 173 may be located in socket 159 to control the ingress and egress of sea water. A valve ring 175 has mating apertures 177. Rotating valve ring 175 changes the flow area of ports 173, 177 to change the dampening. Socket 159 also has a plurality of ports 179 that are employed for the egress of sea water during the down stroke. Check valves 181 prevent sea water from flowing back inward during the upstroke.

The embodiment of FIGS. 18-20 is a variation of the embodiment of FIGS. 15-17. Tendon assembly 183 is vertical, rather than inclined as in FIG. 15. Preferably, there are four separate tendons 185 that are parallel to each other, vertically oriented, and arranged in a rectangular array. Each tendon 185 may be similar to a conventional tendon of a conventional tension leg platform, being made up of tubular members secured together by threaded joints. Each tendon 185 is connected by a flexible connector or joint 186 to a lower counterweight 187. Counterweight 187 has a depending socket 189 as in the other embodiments that slidingly engages a piling 191. Valves may be employed to varying the dampening as in the other embodiments. Socket 189 preferably has an anti-rotation element.

The upper end of each tendon 185 is secured by a flexible top connector 193 to an upper counterweight 195. Upper counterweight 195 is supported at the lower end of an upper riser section 197 as in the embodiment of FIG. 15. Upper riser section 197 comprises a single riser that is much larger in diameter than any of the tendons 185, but much shorter in length. As shown in FIGS. 19 and 20, porches 201 are mounted to the exterior of upper counterweight 195 near the corners. Each top connector 193 mounts to one of the porches 201 in a conventional manner.

Conventional TLP installation techniques can be used consisting of installing all tendon assemblies 183 prior to moving the combined hull 199 and upper riser 197 over the tendon assemblies. Once positioned over the tendon assemblies, the hull 199 and upper riser 197 combination can be ballasted down to engage the tendon assemblies 183. After connection with the tendon assemblies 183, ballast is removed from the hull 199 and upper riser 197 combination until the desired tension is placed in the tendon assemblies. Permanent ballast can then be added to upper riser 197 making it an upper counterweight.

As an alternative, the tendon assembly 183 and buoyant upper rise 197 can be installed prior to moving hull 199 over upper riser 197. In this embodiment, upper riser 197 serves as a temporary buoyancy tank for all of the tendon assemblies.

Once positioned over upper riser 197, hull 199 can be ballasted down to engage upper riser 197. After connection with upper riser 197, ballast is removed from hull 199 until the desired tension is placed in the tendon assemblies. Permanent ballast can then be added to upper riser 197 making it an upper counterweight.

The invention has significant advantages. The platform can be moored with this system without the need for large installation vessels. The platform can be easily relocated for subsequent use. The mooring system is simple in construction and wear resistant.

While the invention has been shown in only a few of its forms, it should be apparent to those skilled in the art that it is not so limited but is susceptible to various changes without departing from the scope of the invention.

I claim:

1. An offshore system for petroleum production, comprising:

a buoyant hull;

a tendon assembly cooperatively engaged with the hull;

a counterweight at a lower end of the tendon assembly to provide tension to the tendon assembly, an anchor member embedded in a sea floor and having an upper end protruding above the sea floor;

an engaging member at the lower end of the tendon assembly that telescopingly engages the upper end of the anchor member to restrict lateral movement of the hull and accommodate heave of the hull; and wherein the upper end of the anchor member and the engaging member define a chamber that varies in volume as the tendon assembly moves up and down due to heave of the hull, the chamber having a port to draw in and expel sea water to dampen the up and down motion of the tendon assembly.

2. The system according to claim 1, wherein the upper end of the anchor member and the engaging member are tubular.

3. The system according to claim 1, further comprising a check valve in the port that provides a greater flow area for the egress of sea water during downward movement of the engaging member than a flow area for the ingress of sea water during upward movement of the engaging member.

4. The system according to claim 1, further comprising at least one external riser extending alongside the tendon assembly to the hull, the external riser adapted to be connected to a subsea wellhead at the sea floor.

5. The system according to claim 1, further comprising an anti-rotation device between the engaging member and the upper end of the anchor member for preventing rotation of the engaging member relative to the anchor member.

6. The system according to claim 1, further comprising a plurality of external risers, each of the external risers adapted to be connected to a subsea wellhead at the sea floor, at least some of the external risers engaging the counterweight to prevent rotation of the counterweight relative to the anchor member.

7. The system according to claim 1, wherein the upper end of the tendon assembly is cylindrical, and the system further comprises:

a cylindrical receptacle in the hull that receives an upper end of the tendon assembly, the receptacle having a plurality of circumferentially spaced lugs;

a plurality of keys spaced around the upper end of the tendon assembly for engaging the lugs; and the tendon assembly secures to the receptacle by relative rotation between the tendon assembly and the receptacle until the keys engage the lugs.

8. The system according to claim 1, wherein the anchor member comprises a caisson, and the engaging member comprises a piston member that locates within the caisson.

9. An offshore system for petroleum production, comprising:

a buoyant hull;

a tendon assembly cooperatively engaged with the hull;

a counterweight at a lower end of the tendon assembly and suspended above the sea floor by the tendon assembly to provide tension to the tendon assembly;

an anchor member embedded in a sea floor and having an upper end protruding above the sea floor;

an engaging member at the lower end of the tendon assembly that telescopingly engages the upper end of the anchor member to restrict lateral movement of the hull and accommodate heave of the hull;

wherein the upper end of the anchor member and the engaging member define a chamber that varies in volume as the tendon assembly moves up and down due to heave of the hull; and wherein the system further comprises:

a port in the chamber to draw in and expel sea water to dampen the up and down motion of the engaging member; and an adjustable valve over the port for adjusting a flow area through the port.

10. An offshore system for petroleum production, comprising:

a buoyant hull;

a tendon assembly cooperatively engaged with the hull;

a counterweight at a lower end of the tendon assembly and suspended above the sea floor by the tendon assembly to provide tension to the tendon assembly;

an anchor member embedded in a sea floor and having an upper end protruding above the sea floor;

an engaging member at the lower end of the tendon assembly that telescopingly engages the upper end of the anchor member to restrict lateral movement of the hull and accommodate heave of the hull; and a plurality of internal risers, each having a separate axis, the internal risers being located in the tendon assembly and extending to the hull for transporting petroleum products between the hull and the sea floor.

11. The system according to claim 10, further comprising:

a plurality of flowlines adapted to be coupled to well equipment on the sea floor and extending to the counterweight; and wherein the internal risers are joined to upper ends of the flowlines at the counterweight.

12. An offshore system for petroleum production, comprising:

a buoyant hull;

a tendon assembly cooperatively engaged with the hull;

a counterweight at a lower end of the tendon assembly and suspended above the sea floor by the tendon assembly to provide tension to the tendon assembly;

an anchor member embedded in a sea floor and having an upper end protruding above the sea floor;

an engaging member at the lower end of the tendon assembly that telescopingly engages the upper end of the anchor member to restrict lateral movement of the hull and accommodate heave of the hull; and wherein the anchor member comprises a tubular piling, and the engaging member comprises a sleeve that slides over the piling.

13. An offshore system for petroleum production, comprising:

a buoyant hull;

a tendon assembly cooperatively engaged with the hull;

a counterweight at a lower end of the tendon assembly and suspended above the sea floor by the tendon assembly to provide tension to the tendon assembly;

an anchor member embedded in a sea floor and having an upper end protruding above the sea floor;

an engaging member at the lower end of the tendon assembly that telescopingly engages the upper end of the anchor member to restrict lateral movement of the hull and accommodate heave of the hull; and wherein the tendon assembly comprises:

an upper riser section extending downward from the hull and a lower tendon section extending downward from the upper riser section, the upper riser section being larger in diameter and shorter in length than the lower tendon section; and the system further comprises:

an upper weight secured to a lower end of the upper riser section.

14. The system according to claim 13, wherein the system further comprises:

a top connector on the upper weight for securing an upper end of the lower tendon section, the upper end of the lower tendon section having a separate axis from an axis of the upper riser section.

15. The system according to claim 13, wherein the system further comprises:

a plurality of top connectors on the upper weight, each securing an upper end of one of the lower tendons to the upper riser section.

16. An offshore system for petroleum production, comprising:

a buoyant hull;

a tendon assembly cooperatively engaged with the hull;

a counterweight at a lower end of the tendon assembly and suspended above the sea floor by the tendon assembly to provide tension to the tendon assembly;

an anchor member embedded in a sea floor and having an upper end protruding above the sea floor;

an engaging member at the lower end of the tendon assembly that telescopingly engages the upper end of the anchor member to restrict lateral movement of the hull and accommodate heave of the hull; and wherein the tendon assembly comprises:

an upper riser section extending downward from the hull and a lower tendon section extending downward from the upper riser section, the upper riser section being larger in diameter and shorter in length than the lower tendon section; and wherein the system further comprises:

a shoulder in a lower end of the upper riser section for supporting an upper end of the lower tendon section; and a hanger on an upper end of the lower tendon section for landing on the shoulder, the lower tendon section being run through the upper riser section.

17. An offshore system for petroleum production, comprising:

a buoyant hull;

a tendon assembly having an upper end secured to the hull for movement with the hull in response to waves and current;

a subsea counterweight at a lower end of the tendon assembly and above the sea floor to provide tension to the tendon assembly, the counterweight being movable in unison with the lower end of the tendon assembly;

an anchor member embedded in a sea floor and having a submerged upper end protruding above the sea floor;

a submerged engaging member at the lower end of the tendon assembly that telescopingly engages the upper end of the anchor member to restrict lateral movement of the hull and moves up and down relative to the anchor member in response to movement of the hull due to waves and current;

wherein the upper end of the anchor member and the engaging member define a chamber that varies in volume as the tendon assembly moves up and down relative to the anchor member, and wherein the system further comprises a port in the chamber for ingress and egress of sea water.

18. The system according to claim 17, further comprising:

a valve mounted to the port for selectively adjusting a flow area of the port.

19. The system according to claim 17, further comprising a check valve that provides a greater flow area for the egress of sea water from the port of the chamber during downward movement of the engaging member than a flow area for the ingress of sea water during upward movement of the engaging member.

20. The system according to claim 17, further comprising an anti-rotation member between the anchor member and the counterweight for preventing rotation of the tendon assembly relative to the anchor member.

21. The system according to claim 17, further comprising a plurality of external risers extending alongside the tendon assembly, each of the external risers adapted to be connected to a subsea wellhead at the sea floor, at least one of the external risers extending through a passage provided in the counterweight so as to prevent rotation of the counterweight relative to the piling.

22. The system according to claim 17, wherein the upper end of the tendon assembly is cylindrical and the system further comprises:

a cylindrical receptacle in the hull that receives an upper end of the tendon assembly, the receptacle having a plurality of circumferentially spaced lugs;

a plurality of keys spaced around the upper end of the tendon assembly for engaging the lugs; and the tendon assembly secures to the receptacle by relative rotation between the tendon assembly and the receptacle until the keys engage the lugs.

23. An offshore system for petroleum production, comprising:

a buoyant hull;

a tendon assembly having an upper end secured to the hull for movement with the hull in response to waves and current;

a subsea counterweight at a lower end of the tendon assembly and above the sea floor to provide tension to the tendon assembly, the counterweight being movable in unison with the lower end of the tendon assembly;

an anchor member embedded in a sea floor and having a submerged upper end protruding above the sea floor;

a submerged engaging member at the lower end of the tendon assembly that telescopingly engages the upper end of the anchor member to restrict lateral movement of the hull and moves up and down relative to the anchor member in response to movement of the hull due to waves and current;

a plurality of internal risers, each having a separate axis, the internal risers being located in the tendon assembly and extending to the hull for transporting petroleum products between the hull and equipment on the sea floor.

24. The system according to claim 23, further comprising:

a plurality of flowlines adapted to be coupled to well equipment on the sea floor and extending to the counterweight; and wherein the internal risers are joined to upper ends of the flowlines at the counterweight.

25. An offshore system for petroleum production, comprising:

a buoyant hull;

a tendon assembly having an upper end secured to the hull for movement with the hull in response to waves and current;

a subsea counterweight at a lower end of the tendon assembly and above the sea floor to provide tension to the tendon assembly, the counterweight being movable in unison with the lower end of the tendon assembly;

an anchor member embedded in a sea floor and having a submerged upper end protruding above the sea floor;

a submerged engaging member at the lower end of the tendon assembly that telescopingly engages the upper end of the anchor member to restrict lateral movement of the hull and moves up and down relative to the anchor member in response to movement of the hull due to waves and current; wherein the tendon assembly comprises:

an upper riser section extending downward from the hull and a lower tendon section extending downward from the upper riser section, the upper riser section being larger in diameter and shorter in length than the lower tendon section; and the system further comprises:

an upper weight secured to a lower end of the upper riser section.

26. The system according to claim 25, wherein the system further comprises:

a shoulder in the lower end of the upper riser section; and a hanger on an upper end of the lower tendon section for landing on the shoulder, the lower tendon section being run through the upper riser section.

27. The system according to claim 25, wherein the system further comprises:

a top connector on the upper weight for securing an upper end of the lower tendon section, the upper end of the lower tendon section having a separate axis from an axis of the upper riser section.

28. An offshore system for petroleum production, comprising:

a buoyant hull;

a tendon assembly having an upper end secured to the hull for movement with the hull in response to waves and current;

a subsea counterweight at a lower end of the tendon assembly and above the sea floor to provide tension to the tendon assembly, the counterweight being movable in unison with the lower end of the tendon assembly;

an anchor member embedded in a sea floor and having a submerged upper end protruding above the sea floor;

a submerged engaging member at the lower end of the tendon assembly that telescopingly engages the upper end of the anchor member to restrict lateral movement of the hull and moves up and down relative to the anchor member in response to movement of the hull due to waves and current; wherein the tendon assembly comprises:

an upper riser section extending downward from the hull and a plurality of spaced apart, parallel lower tendons extending downward from the upper riser section, the upper riser section being larger in diameter and shorter in length than any of the lower tendons; and wherein the system further comprises:

an upper weight at a lower end of the upper riser section; and a plurality of top connectors on the upper weight, each top connector securing an upper end of one of the lower tendons.

* * * * *